US011911870B2

(12) United States Patent
Ganapathiappan et al.

(10) Patent No.: US 11,911,870 B2
(45) Date of Patent: Feb. 27, 2024

(54) POLISHING PADS FOR HIGH TEMPERATURE PROCESSING

(71) Applicant: Applied Materials, Inc., Santa Clara, CA (US)

(72) Inventors: Sivapackia Ganapathiappan, Los Altos, CA (US); Rajeev Bajaj, Fremont, CA (US); Yingdong Luo, San Jose, CA (US); Aniruddh Jagdish Khanna, Fremont, CA (US); You Wang, Cupertino, CA (US); Daniel Redfield, Morgan Hill, CA (US)

(73) Assignee: Applied Materials, Inc., Santa Clara, CA (US)

( * ) Notice: Subject to any disclaimer, the term of this patent is extended or adjusted under 35 U.S.C. 154(b) by 41 days.

(21) Appl. No.: 17/472,006

(22) Filed: Sep. 10, 2021

(65) Prior Publication Data

US 2023/0080430 A1 Mar. 16, 2023

(51) Int. Cl.

| | |
|---|---|
| ***B24B 37/24*** | (2012.01) |
| ***B24B 37/26*** | (2012.01) |
| ***B24B 37/22*** | (2012.01) |

(52) U.S. Cl.

CPC ..... *B24B 37/24* (2013.01); *B24B 37/26* (2013.01); *B24B 37/22* (2013.01)

(58) Field of Classification Search

CPC ..... B24B 37/20; B24B 37/22; B24B 37/24; B24B 37/26; B24B 37/245; B24D 3/20;

(Continued)

(56) References Cited

U.S. PATENT DOCUMENTS

| | | | |
|---|---|---|---|
| 10,391,605 | B2 | 8/2019 | Ganapathiappan et al. |
| 2020/0001433 | A1 | 1/2020 | Bajaj et al. |

(Continued)

FOREIGN PATENT DOCUMENTS

| | | | |
|---|---|---|---|
| JP | 2015-226940 | A | 12/2015 |
| KR | 10-2021-0051265 | A | 5/2021 |

(Continued)

OTHER PUBLICATIONS

International Search Report and Written Opinion for International Application No. PCT/US2022/041346 (APPM/44020192WO01) dated Dec. 5, 2022.

*Primary Examiner* — Joel D Crandall
*Assistant Examiner* — Sukwoo James Chang
(74) *Attorney, Agent, or Firm* — Patterson + Sheridan, LLP

(57) ABSTRACT

Embodiments herein generally relate to polishing pads and methods of forming polishing pads. A polishing pad includes a plurality of polishing elements. Each polishing element comprises an individual surface that forms a portion of a polishing surface of the polishing pad and one or more sidewalls extending downwardly from the individual surface to define a plurality of channels disposed between the polishing elements. Each of the polishing elements has a plurality of pore-features formed therein. Each of the polishing elements is formed of a pre-polymer composition and a sacrificial material composition. In some cases, a sample of the cured pre-polymer composition has a glass transition temperature ($T_g$) of about 80° C. or greater. A storage modulus (E') of the cured pre-polymer composition at a temperature of 80° C. (E'80) can be about 200 MPa or greater.

20 Claims, 8 Drawing Sheets

(58) Field of Classification Search
CPC . B24D 3/28; B24D 3/32; B24D 3/285; B24D 18/0027; B24D 18/009; B24D 17/0072
See application file for complete search history.

(56) References Cited

U.S. PATENT DOCUMENTS

| | | | | |
|---|---|---|---|---|
| 2020/0070302 | A1* | 3/2020 | Ganapathiappan | C08F 290/061 |
| 2020/0230781 | A1* | 7/2020 | Chockalingam | B24B 37/26 |
| 2021/0187693 | A1 | 6/2021 | Khanna et al. | |

FOREIGN PATENT DOCUMENTS

| | | | | |
|---|---|---|---|---|
| WO | WO2010009420 | A1 * | 1/2010 | B24B 37/04 |
| WO | 2020-109947 | A1 | 6/2020 | |

* cited by examiner

POLISHING PADS FOR HIGH TEMPERATURE PROCESSING

BACKGROUND

Field

Embodiments of the present disclosure generally relate to polishing pads, and methods of manufacturing polishing pads, and more particularly, to polishing pads used for chemical mechanical polishing (CMP) of a substrate in an electronic device fabrication process.

Description of the Related Art

Chemical mechanical polishing (CMP) is commonly used in the manufacturing of high-density integrated circuits to planarize or polish a layer of material deposited on a substrate. A CMP process includes contacting the material layer to be planarized with a polishing pad and moving the polishing pad, the substrate, or both, to create relative movement between the material layer surface and the polishing pad, in the presence of a polishing fluid including abrasive particles, chemically active components, or both.

One common application of a CMP process in semiconductor device manufacturing is planarization of a bulk film, for example pre-metal dielectric (PMD) or interlayer dielectric (ILD) polishing, where underlying two or three-dimensional features create recesses and protrusions in the to be planarized material surface. Other common applications of CMP processes in semiconductor device manufacturing include shallow trench isolation (STI) and interlayer metal interconnect formation, where the CMP process is used to remove the via, contact, or trench fill material (overburden) from the exposed surface (field) of the material layer having the STI or metal interconnect features disposed therein.

Often, polishing pads used in CMP processes are selected based on material properties of the polishing pad and the suitability of those material properties for the desired CMP application. One example material property that affects the performance of a polishing pad for a desired CMP application is the storage modulus of the polishing layer. Generally, polishing pads formed of comparatively harder materials provide superior local planarization performance when compared to polishing pads formed of softer materials. However, polishing pads formed of harder materials are also associated with increased defectivity, such as undesirable scratches in a substrate surface, when compared with softer polishing pads. Unfortunately, conventional polishing pads soften at high temperatures, thereby reducing their ability to maintain desirable hardness over a wide temperature range.

Accordingly, there is a need in the art for polishing pads that maintain their material properties and provide stable performance over a wide temperature range.

SUMMARY

Embodiments described herein generally relate to polishing pads, and methods for manufacturing polishing pads which may be used in a chemical mechanical polishing (CMP) process. More particularly, embodiments herein provide for polishing pads that maintain consistent material properties and stable performance over a wide temperature range.

In one embodiment, a polishing pad includes a plurality of polishing elements. Each polishing element comprises an individual surface that forms a portion of a polishing surface of the polishing pad and one or more sidewalls extending downwardly from the individual surface to define a plurality of channels disposed between the polishing elements. Each of the polishing elements has a plurality of pore-features formed therein. Each of the polishing elements is formed of a pre-polymer composition and a sacrificial material composition. A sample of the cured pre-polymer composition has a glass transition temperature ($T_g$) of about 80° C. or greater. A storage modulus (E') of the cured pre-polymer composition at a temperature of 80° C. (E'80) is about 200 MPa or greater.

In another embodiment, a method of forming a polishing pad includes a plurality of polishing elements formed of a pre-polymer composition. The pre-polymer composition includes an isobornyl acrylate (IBXA) concentration of about 30 wt % to about 40 wt %, a 3,3,5-Trimethylcyclohexyl acrylate (TMCHA) concentration of about 10 wt % to about 15 wt %, a difunctional aliphatic urethane methacrylate concentration of about 40 wt % to about 50 wt %, and a difunctional aliphatic urethane acrylate oligomer concentration of about 5 wt % to about 10 wt %.

In another embodiment, a method of polishing a substrate includes disposing a substrate in a polishing system, urging a material surface of the substrate against a polishing pad, the polishing pad having a plurality of polishing elements formed of a pre-polymer composition, and operating the polishing system at a temperature of about 80° C. or greater. A storage modulus (E') of the pre-polymer composition at the operating temperature is about 200 MPa or greater.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1:
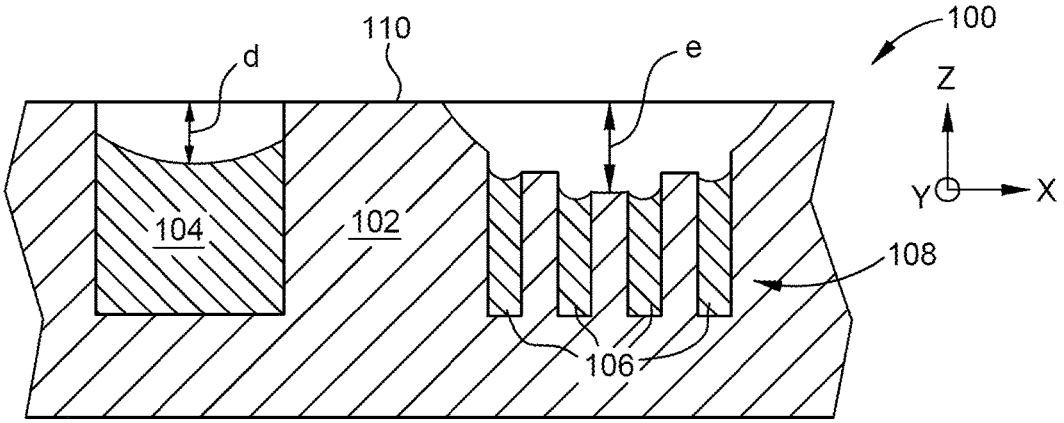
FIG. 1 is a schematic sectional view illustrating local planarization of a portion of a substrate following a chemical mechanical polishing (CMP) process using a conventional polishing pad.

To facilitate understanding, identical reference numerals have been used, where possible, to designate identical elements that are common to the figures. It is contemplated that elements and features of one implementation may be beneficially incorporated in other implementations without further recitation.

DETAILED DESCRIPTION

Embodiments described herein generally relate to polishing pads, and methods for manufacturing polishing pads, which may be used in a chemical mechanical polishing (CMP) process. In particular, the polishing pads described herein maintain consistent material properties and stable performance over a wide temperature range.

Undesirably poor local planarization performance typically associated with conventional polishing pads formed of relatively softer materials is schematically illustrated in FIG. 1. FIG. 1 is a schematic sectional view illustrating poor local planarization, e.g., erosion to a distance e and dishing to a distance d, following a CMP process to remove an overburden of metal fill material from the field, i.e., upper or outer, surface of a substrate 100. Here, the substrate 100 features a dielectric layer 102, a first metal interconnect feature 104 formed in the dielectric layer 102, and a plurality of second metal interconnect features 106 formed in the dielectric layer 102. The plurality of second metal interconnect features 106 are closely arranged to form a high feature density region 108 of relatively high feature density. Typically, the metal interconnect features 104, 106 are formed by depositing a metal fill material onto the dielectric layer 102 and into corresponding openings formed therein. The material surface of the substrate 100 is then planarized using a CMP process to remove the overburden of fill material from the field surface 110 of the dielectric layer 102. If the polishing pad selected for the CMP process provides relatively poor local planarization performance, the resulting upper surface of the metal interconnect feature 104 may be recessed a distance d from the surrounding surfaces of the dielectric layer 102, otherwise known as dishing. Poor local planarization performance may also result in undesirable recessing of the dielectric layer 102 in the high feature density region 108, e.g., distance e, where the upper surfaces of the dielectric layer 102 in the high feature density region 108 are recessed from the plane of the field surface 110, otherwise known as erosion. Metal loss resulting from dishing and/or erosion can cause undesirable variation in the effective resistance of the metal interconnect features 104, 106 formed therefrom thus affecting device performance and reliability.

Embodiments described herein reduce dishing and erosion over a wide range of feature sizes compared to conventional polishing pad materials. In addition, embodiments described herein have more stable or consistent dishing and erosion performance compared to conventional polishing pad materials.

Embodiments described herein provide polishing pad materials having values of glass transition temperature ($T_g$) that are greater than $T_g$ values for conventional pad materials. In some embodiments, $T_g$ values are raised by adding high $T_g$ monomers and/or by adding cross-linkers to increase cross-linking density, which increases $T_g$. In some embodiments, the greater $T_g$ values of the polishing pad materials described herein provide consistent material properties and stable performance over a wider temperature range, including at higher temperatures, compared to conventional pad materials.

Embodiments described herein provide polishing pad materials having values of storage modulus E' at a temperature of about 80° C. (E'80) that are greater than E'80 values for conventional pad materials. For example, E'80 values for pad materials disclosed herein may be about 200 MPa or greater, in contrast to conventional pad materials with E'80 values well below 150 MPa, such as about 100 MPa or less.

Embodiments described herein provide polishing pads with segmented polishing elements that are disposed on a relatively more compliant foundation layer. Therefore, non-uniformity is reduced compared to conventional pad materials even though the higher $T_g$ values may be expected to increase polishing non-uniformity due to the harder pad materials being less compliant to the surface of the substrate.

Although embodiments described herein are generally related to chemical mechanical polishing (CMP) pads used in semiconductor device manufacturing, the polishing pads and manufacturing methods thereof are also applicable to other polishing processes using both chemically active and chemically inactive polishing fluids and/or polishing fluids free from abrasive particles. In addition, embodiments described herein, alone or in combination, may be used in at least the following industries: aerospace, ceramics, hard disk drive (HDD), MEMS and Nano-Tech, metalworking, optics and electro-optics manufacturing, and semiconductor device manufacturing, among others.

Exemplary Polishing System

Figure 2:
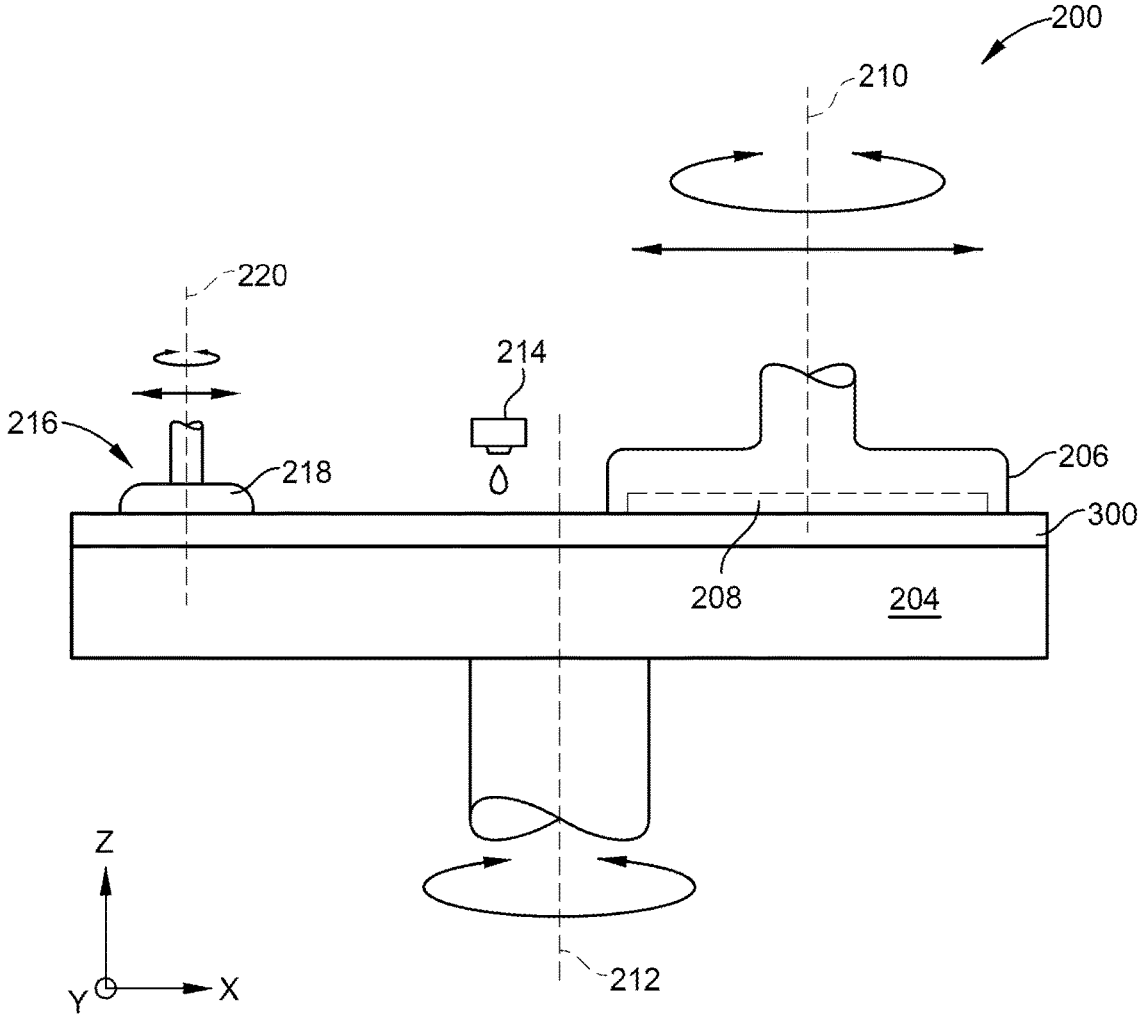
FIG. 2 is a schematic side view of an exemplary polishing system configured to use a polishing pad formed according to embodiments described herein.

FIG. 2 is a schematic side view of an exemplary polishing system 200 configured to use a polishing pad 300 formed according to embodiments described herein. The polishing pad 300 is further described in FIG. 3.

Here, the polishing system 200 features a platen 204, having the polishing pad 300 secured thereto using a pressure sensitive adhesive, and a substrate carrier 206. The substrate carrier 206 faces the platen 204 and the polishing pad 300 mounted thereon. The substrate carrier 206 is used to urge a material surface of a substrate 208, disposed therein, against the polishing surface of the polishing pad 300 while simultaneously rotating about a carrier axis 210. Typically, the platen 204 rotates about a platen axis 212 while the rotating substrate carrier 206 sweeps back and forth from an inner diameter to an outer diameter of the platen 204 to, in part, reduce uneven wear of the polishing pad 300.

The polishing system 200 further includes a fluid delivery arm 214 and a pad conditioner assembly 216. The fluid delivery arm 214 is positioned over the polishing pad 300 and is used to deliver a polishing fluid, such as a polishing slurry having abrasives suspended therein, to a surface of the polishing pad 300. Typically, the polishing fluid contains a pH adjuster and other chemically active components, such as an oxidizing agent, to enable chemical mechanical polishing of the material surface of the substrate 208. The pad conditioner assembly 216 is used to condition the polishing pad 300 by urging a fixed abrasive conditioning disk 218 against the surface of the polishing pad 300 before, after, or during polishing of the substrate 208. Urging the conditioning disk 218 against the polishing pad 300 includes rotating the conditioning disk 218 about a conditioner axis 220 and sweeping the conditioning disk 218 from an inner diameter the platen 204 to an outer diameter of the platen 204. The conditioning disk 218 is used to abrade and rejuvenate the polishing pad 300 polishing surface, and to remove polish byproducts or other debris from the polishing surface of the polishing pad 300.

Polishing Pad Examples

The polishing pads described herein include a foundation layer and a polishing layer disposed on the foundation layer. The polishing layer forms the polishing surface of the polishing pad and the foundation layer provides support for the polishing layer as a to-be-polished substrate is urged thereagainst. The foundation layer and the polishing layer are formed of different pre-polymer compositions that, when cured, have different material properties. The foundation layer and the polishing layer are integrally and sequentially formed using a continuous layer-by-layer additive manufacturing process. The additive manufacturing process provides a polishing pad body having a continuous polymer phase between the polishing layer and the foundation layer thus eliminating the need for an adhesive layer or other bonding method therebetween. In some embodiments, the polishing layer is formed of a plurality of polishing elements, which are separated from one another across the polishing surface by recesses, and/or channels, disposed therebetween.

The term "pore-feature," as used herein includes openings defined in the polishing surface, voids that are formed the polishing material below the polishing surface, pore-forming features disposed in the polishing surface, pore-forming features disposed in polishing material below the polishing surface, and combinations thereof. Pore-forming features typically include a water-soluble-sacrificial material that dissolves upon exposure to a polishing fluid thus forming a corresponding opening in the polishing surface and/or void in the polishing material below the polishing surface. In some embodiments, the water-soluble-sacrificial material may swell upon exposure to a polishing fluid thus deforming the surrounding polishing material to provide asperities at the polishing pad material surface. The resulting pores and asperities desirably facilitate transporting liquid and abrasives to the interface between the polishing pad and a to-be-polished material surface of a substrate, and temporarily fixes those abrasives (abrasive capture) in relation to the substrate surface to enable chemical and mechanical material removal therefrom.

In some embodiments, the polishing material of the polishing pad may be formed from different pre-polymer compositions, or different ratios of the different pre-polymer compositions, to provide unique material properties.

Generally, the methods set forth herein use an additive manufacturing system, e.g., a 2D or a 3D inkjet printer system, to form (print) at least portions of the polishing pads in a layer-by-layer process. Typically, each print layer is formed (printed) by sequentially depositing and at least partially curing droplets of desired pre-polymer compositions and/or pore-forming sacrificial material precursor compositions on a manufacturing support or a previously formed print layer. Beneficially, the additive manufacturing system and the methods set forth herein enable at least micron scale droplet placement control within each print layer (X-Y resolution) as well as micron scale (0.1 μm to 200 μm) control over the thickness (Z resolution) of each print layer. The micron scale X-Y and Z resolutions provided by the additive manufacturing systems and the methods set forth herein facilitate the formation of desirable and repeatable patterns of the pore-features described herein. Thus, in some embodiments, the additive manufacturing methods used to from the polishing pads also impart one or more distinctive structural characteristics of the polishing pads formed therefrom.

Figure 3:
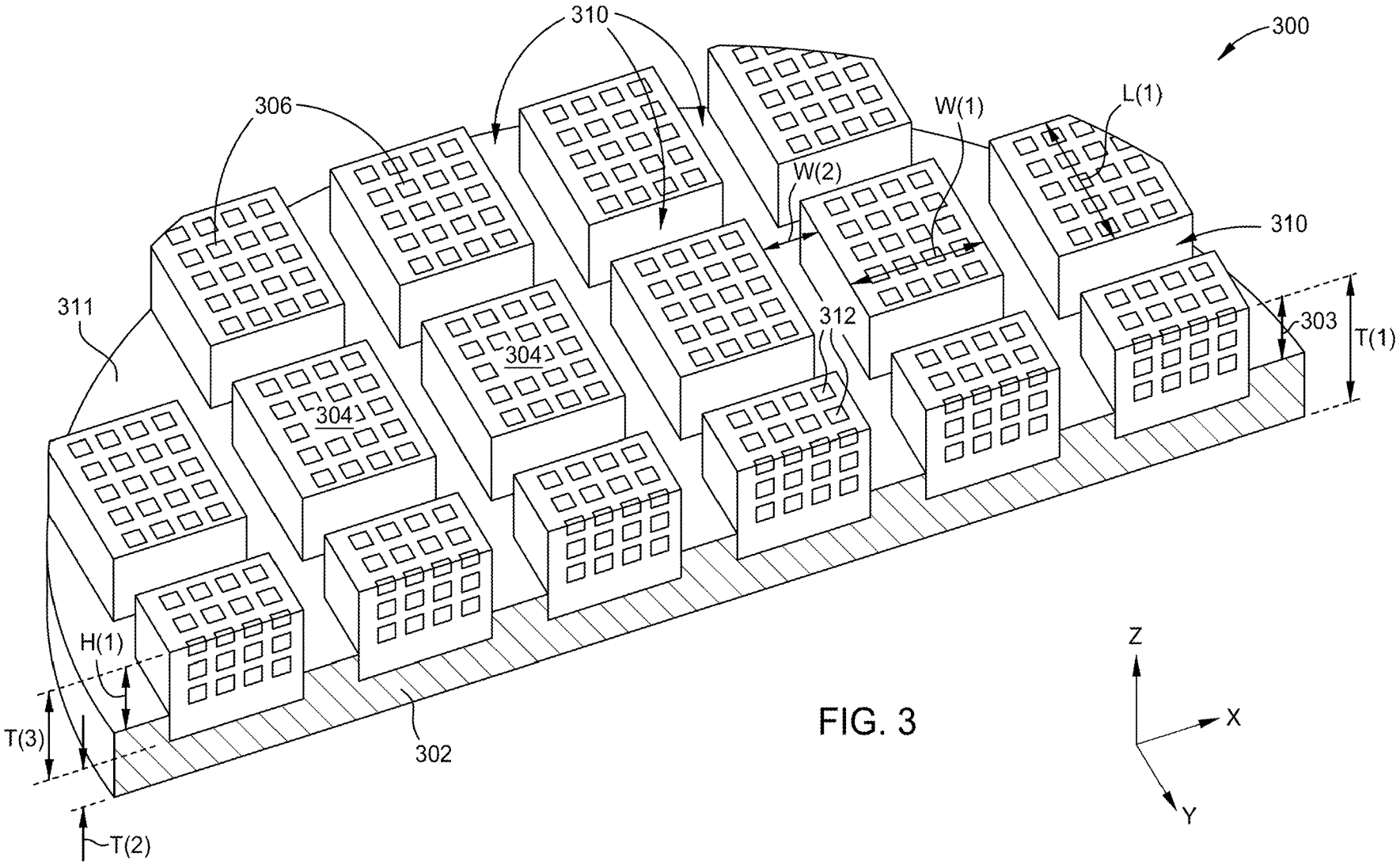
FIG. 3 is a schematic isometric sectional view of a polishing pad, which may be formed using the methods set forth herein.

FIG. 3 is a schematic isometric sectional view of a polishing pad 300, which may be formed using the methods set forth herein. Here, the polishing pad 300 includes a foundation layer 302 and a polishing layer 303 disposed on the foundation layer 302 and integrally formed therewith using an additive manufacturing process. The additive manufacturing process allows for co-polymerization of different pre-polymer compositions used to respectively form the foundation layer 302 and the polishing layer 303, thus providing a continuous phase of polymer material across the interfacial boundary regions therebetween.

Here, the polishing layer 303 is formed of a plurality of polishing elements 304 that extend upwardly from the foundation layer 302 to form a polishing surface 306. In the illustrated embodiments, the plurality of polishing elements 304 are spaced apart from one another to define a plurality of channels 310 therebetween. The plurality of channels 310 are disposed between adjacent ones of the plurality of polishing elements 304 and between a plane of the polishing surface 306 and an upward facing surface 311 of the foundation layer 302. The plurality of channels 310 facilitate the distribution of polishing fluids across the polishing pad 300 and to an interface between the polishing surface 306 and a material surface of a substrate to be polished thereon. The plurality of polishing elements 304 are supported in a thickness direction (Z direction) of the polishing pad 300 by a portion of the foundation layer 302. Thus, when a load is applied to the polishing surface 306 by a substrate urged thereagainst, the load will be transmitted through the polishing elements 304 and to the portion of the foundation layer 302 disposed therebeneath.

Here, the plurality of polishing elements 304 are formed to have a substantially rectangular shape (square as shown) when viewed from top down and are arranged so that the plurality of channels 310 defined therebetween form an X-Y grid pattern. Alternate shapes and/or arrangements of polishing elements that may be used for the polishing elements 304, and the channels 310 defined therefrom, are illustrated in FIG. 4 and FIGS. 5A-5F. In some embodiments, the shapes, dimensions, and/or arrangements of the polishing elements 304, and/or the channels 310 disposed therebetween, are varied across the polishing pad 300 to tune hardness, mechanical strength, fluid transport characteristics, and/or other desirable properties thereof. In some embodiments, the polishing layer 303 may not include discrete polishing elements and/or channels 310 defined between polishing surfaces of adjacent polishing elements may not extend through to the foundation layer 302.

Here, the polishing pad 300 has a first thickness T(1) measured between a platen mounting surface and the polishing surface 306 of between about 5 mm and about 30 mm. The foundation layer 302 has a second thickness T(2) of between about ⅓ to about ⅔ of the first thickness T(1). The polishing elements 304 have a third thickness T(3) that is between about ⅓ and about ⅔ of the first thickness T(1). As shown, at least a portion of the polishing elements 304 extend through an X-Y plane of the upward facing surface 311 of the foundation layer 302 to a location inside the foundation layer 302. The remaining portion of the polishing elements 304 extend upwardly or outwardly of the foundation layer 302 by a height H(1) from the X-Y plane of the upward facing surface 311 of the foundation layer 302. The height H(1) of the polishing elements 304 defines a depth of the channels 310 interposed therebetween. In some embodiments, the height H(1) of the polishing elements 304, and thus the depth of the channels 310, is about ½ of the first thickness T(1) or less. In some embodiments, a height H(1) of the polishing elements 304, and thus the depth of the channels 310, is about 15 mm or less, such as about 10 mm or less, about 5 mm or less, or between about 100 μm and about 5 mm, such as about 800 μm.

Here, at least one lateral dimension of the polishing elements 304, e.g., one or both of W(1) and L(1) when viewed from above, is between about 5 mm and about 30 mm, such as between about 5 mm and about 20 mm, or between about 5 mm and about 15 mm. The upper surfaces of the polishing elements 304 are parallel to the X-Y plane and form a polishing surface 306, which together form the total polishing surface of the polishing pad 300. Sidewalls of the polishing elements 304 are substantially vertical (orthogonal to the X-Y plane), such as within about 20° of vertical, or within 10° of vertical. Individual ones of the plurality of polishing elements 304 are spaced apart from one another in the X-Y plane by a width W(2) of the individual channels 310 defined therebetween. Here, the width W(2) of the individual channels 310 is more than about 100 μm and less than about 5 mm, such as less than about 4 mm, less than about 3 mm, less than about 2 mm, or less than about 1 mm. In some embodiments, one or both of the lateral dimensions W(1) and L(1) of the polishing elements 304 and/or the width W(2) of the individual channels 310 vary across a radius of the polishing pad 300 to allow fine tuning of the polishing performance thereof.

The polishing elements 304 include a plurality of pore-features 312 disposed therein. The plurality of pore-features 312 may be disposed in any desired vertical arrangement when viewed in cross-section. For example, in FIG. 3, the plurality of pore-features 312 are vertically disposed in columnar arrangements where the pore-features 312 in each of the columns are in substantial vertical alignment. In some other examples, groups of rows or individual rows of pore-features 312 in the depth direction of the polishing elements 304 may be offset in one or both of X-Y directions to provide corresponding pore-features 312 below the polishing surface 306 that are vertically staggered with respect to the pore-features 312 disposed there above and/or there below. The orientation of the pore-features 312 can be advantageously used to adjust the compliance of the polishing material with respect to a direction of the load exerted by a substrate that is being polished thereon. Thus, in one example, the staggered pore-features 312 may be advantageously used to adjust and/or control the polishing planarization performance of a polishing pad formed therefrom.

In some embodiments, the individual pore-features 312 may have a height of about 600 μm or less, such as about 500 μm or less, about 400 μm or less, about 300 μm or less, about 200 μm or less, about 100 μm or less, about 50 μm or less, about 40 μm or less, about 30 μm or less, about 20 μm or less, or about 10 μm or less. The height of individual pore-features 312 is typically a multiple, e.g., 1X or more, of a thickness of the each of the print layers. For example, the thickness of the pore-features within a print layer may be the same as the thickness of the continuous polymer phase of polishing material disposed adjacent thereto. Thus, if pore-features laterally disposed within at least two sequentially deposited print layers are aligned or at least partially overlap in the Z-direction, the thickness of the resulting pore-feature is at least the combined thickness of the at least two sequentially deposited print layers. In some embodiments, one or more of the pore-features do not overlap with a pore-feature in an adjacent layer disposed there above or there below and thus has a thickness of a single print layer.

In some embodiments, the individual pore-features 312 are formed to have lateral dimensions (e.g., length/width or diameter) measured in an X-Y plane of about 600 μm or less, such as about 500 μm or less, about 400 μm or less, about 300 μm or less, about 200 μm or less, about 100 μm or less, about 50 μm or less, about 40 μm or less, about 30 μm or less, about 20 μm or less, or about 10 μm or less and about 5 μm or more, such as about 10 μm or more, about 25 μm or more, or about 50 μm or more. In some embodiments, the mean lateral dimensions of the individual pore-features 312 are between about 50 μm and about 600 μm. In some embodiments, the pore-features 312 are formed to be relatively narrow in the X-Y plane compared to the height thereof, for example, in some embodiments lateral dimensions of the individual pore-features are about ⅔ or less than the height thereof, such as about ½ or less, or about ⅓ or less.

Here, individual ones of the plurality of pore-features 312 are spaced apart in the vertical direction by one or more printed layers of polymer material formed therebetween. In some examples, spacing between pore-features 312 in a vertical direction may be about 100 μm or less, such as about 40 μm or less, such as about 10 μm or less, or about 10 μm to about 40 μm. The pore-features 312 may form a substantially closed-celled structure once the sacrificial-material used to form the pore-features is removed therefrom. In one example, spacing between pore-features 312 in the vertical direction may be about 40 μm. The 40 μm spacing can be formed by disposing four 10 μm print layers of the polymer material between the printed layers that include the pore-features 312. In another example, spacing between pore-features 312 in the vertical direction may be about 10 μm. The 10 μm spacing can be formed by disposing four 2.5 μm print layers of the polymer material between the printed layers that include the pore-features 312.

In other embodiments one or more of the pore-features 312, or portions thereof, are not spaced apart from one or more of the pore-features 312 adjacent thereto and thus form a more open-celled structure once the sacrificial-material is removed therefrom. A thickness of the one or more printed layers may be about 5 μm or more, such as about 10 μm or more, 20 μm or more, 30 μm or more, 40 μm or more, or 50 μm or more. The individual pore-features 312 may be formed within a corresponding single print layer and thus have a height corresponding to the thickness of the print layer or may be formed within two or more adjacent print layers to provide a pore height corresponding to the cumulative thickness thereof.

The polishing elements 304 are formed of a continuous polymer phase of polymer material. The polymer material may have a relatively low storage modulus (E'), i.e., a soft pad material, a relatively high storage modulus E', i.e., a hard pad material, or a relatively medium storage modulus E' between the relatively low and relatively high storage modulus, i.e., a medium pad material. In some examples, the polymer material may have a generally homogenous material composition. In some other examples, the polymer material may include at least two pre-polymer compositions, and thus include a combination of low, medium, or high storage modulus E' materials with a difference from one another in one or more material properties. Characterizations of the low, medium, and high storage modulus E' materials at a temperature of about 30° C. (E'30) are summarized in Table 1.

TABLE 1

| | Low Storage Modulus Compositions | Medium Storage Modulus Compositions | High Storage Modulus Compositions |
|---|---|---|---|
| E'30 | <100 MPa, (e.g., 1 MPa-100 MPa) | 100 MPa-500 MPa | >500 MPa (e.g., 500 MPa-3000 MPa) |

Figure 4:
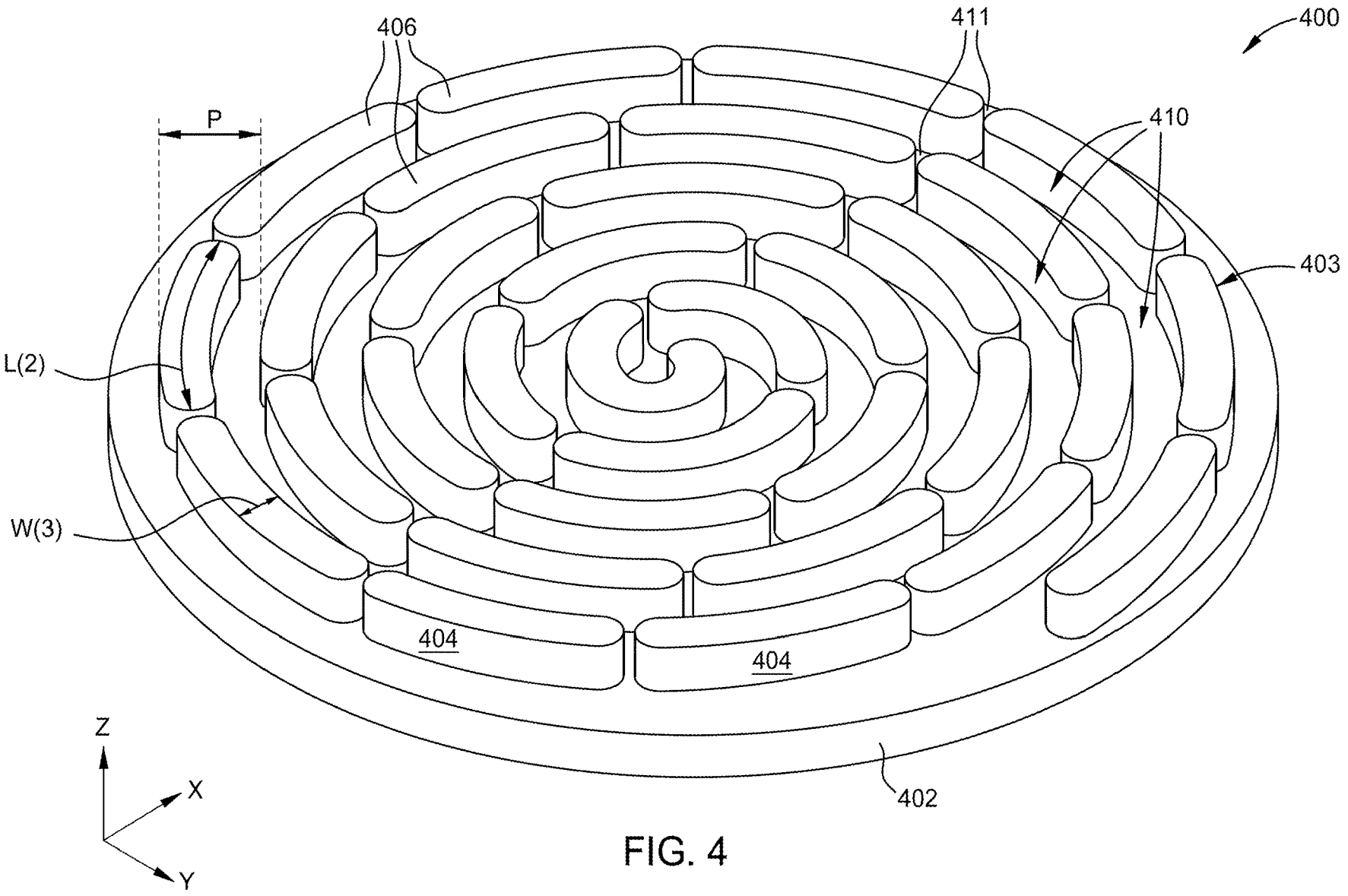
FIG. 4 is a schematic isometric view of a polishing pad according to embodiments described herein.

FIG. 4 schematically illustrates a polishing pad 400 featuring alternate shapes for the polishing elements 404 formed thereon, according to some embodiments. FIG. 4 is a schematic isometric view of the polishing pad 400. Features of the polishing pad 400 may be incorporated into or combined with any of the features of the polishing pad 300 described above.

Here, the polishing pad 400 includes a foundation layer 402 and a polishing layer 403 disposed on the foundation layer 402 and integrally formed therewith to provide a continuous phase of polymer material across the interfacial boundary regions therebetween. The polishing layer 403 is formed of a plurality of discrete polishing elements 404 disposed on or partially within the foundation layer 402. The plurality of polishing elements 404 extend upwardly from an upward facing surface 411 of the foundation layer 402 to form a polishing surface 406. The plurality of polishing elements 404 are spaced apart from one another to define a plurality of channels 410 therebetween. Here, the plurality of polishing elements 404 are arranged to form corresponding segments of a spiral pattern. The spiral pattern extends from an inner radius of the polishing pad 400 to an outer radius proximate to the circumference of the polishing pad 400. Here, individual ones of the plurality of polishing elements have an arc length L(2) of between about 2 mm and about 200 mm and a width W(3) of between about 200 μm and about 10 mm, such as between about 1 mm and about 5 mm. A pitch P between the maximum radius sidewalls of radially adjacent polishing elements 404 may be between about 0.5 mm and about 20 mm, such as between about 0.5 mm and about 10 mm. In some embodiments, one or both of the arc length L(2), the width W(3), and the pitch P vary across a radius of the polishing pad 400 to define regions of different localized polishing performance.

FIGS. 5A-5F are schematic plan views of polishing pads 500*a-f* having various shapes and/or arrangements of polishing elements 504*a-f* that may be used in combination with or in place of any of the other polishing element shapes and/or arrangements described herein. Each of the FIGS. 5A-5F includes a pixel chart having white regions (regions in white pixels) that represent the polishing elements 504*a-f* and black regions (regions in black pixels) that represent the foundation layer 502, as viewed from above.

Figure 5A:
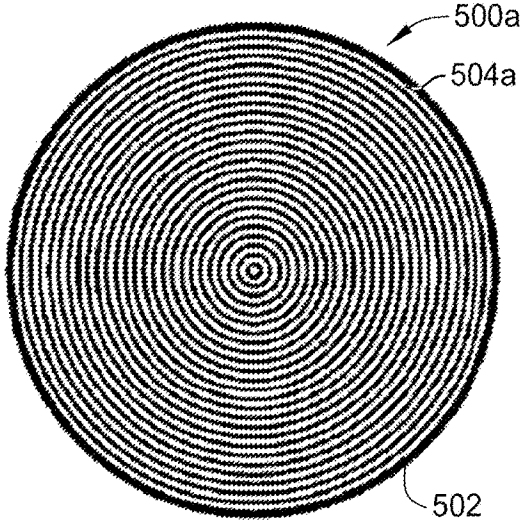
FIGS. 5A-5F are schematic plan views of various polishing pad designs which may be used in place of the pad design shown in FIG. 4 according to embodiments described herein.
Figure 5B:
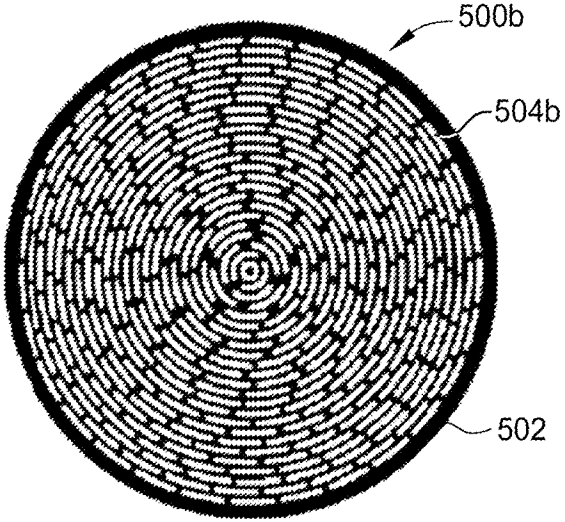
Figure 5C:
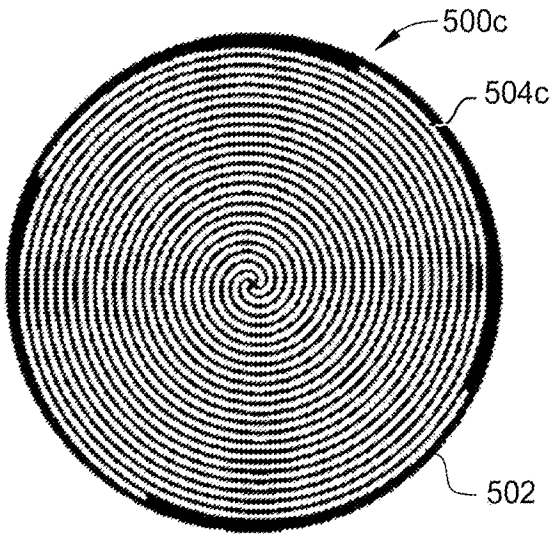
Figure 5D:
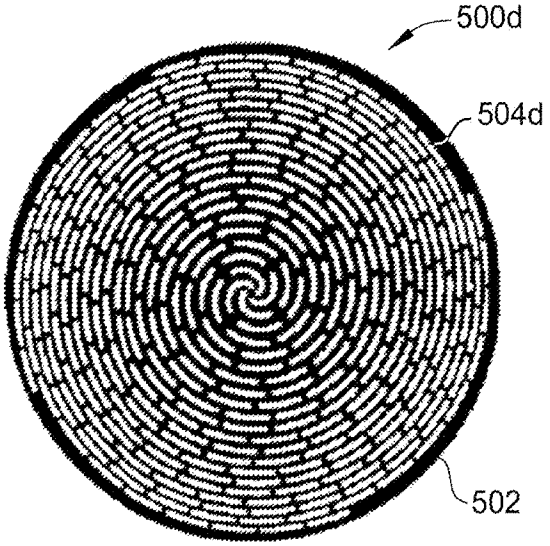

In FIG. 5A, the polishing elements 504*a* include a plurality of concentric annular rings. In FIG. 5B, the polishing elements 504*b* include a plurality of segments of concentric annular rings. In FIG. 5C, the polishing elements 504*c* form a plurality of spirals (four shown) extending from a center of the polishing pad 500*c* to an edge of the polishing pad 500*c* or proximate thereto. In FIG. 5D, a plurality of discontinuous polishing elements 504*d* are arranged in a spiral pattern on the foundation layer 502.

Figure 5E:
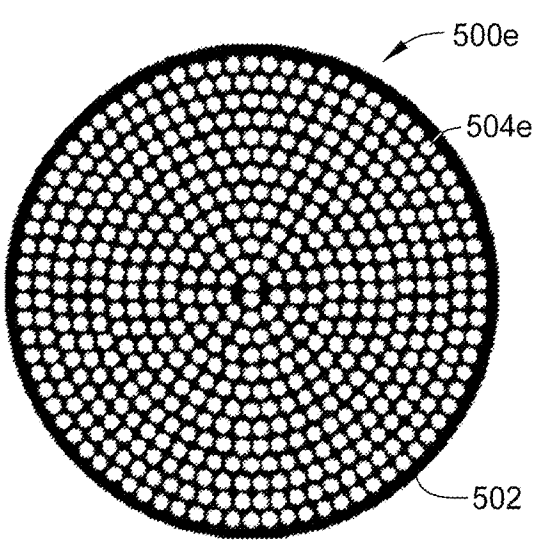
Figure 5F:
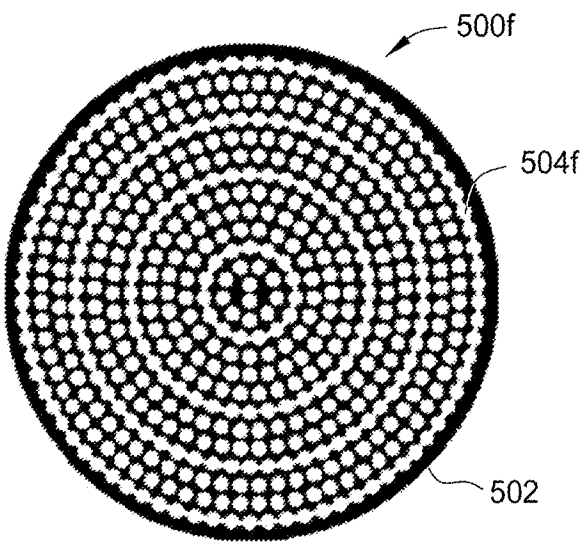

In FIG. 5E, each of the plurality of polishing elements 504*e* includes a cylindrical post extending upwardly from the foundation layer 502. In other embodiments, the polishing elements 504*e* are of any suitable cross-sectional shape, for example columns with toroidal, partial toroidal (e.g., arc), oval, square, rectangular, triangular, polygonal, irregular shapes in a section cut generally parallel to the underside surface of the pad 500*e*, or combinations thereof. FIG. 5F illustrates a polishing pad 500*f* having a plurality of discrete polishing elements 504*f* extending upwardly from the foundation layer 502. The polishing pad 500*f* of FIG. 5F is similar to the polishing pad 500*e* except that some of the polishing elements 504*f* are connected to form one or more closed circles. The one or more closed circles create damns to retain polishing fluid during a CMP process.

Additive Manufacturing System

Figure 6A:
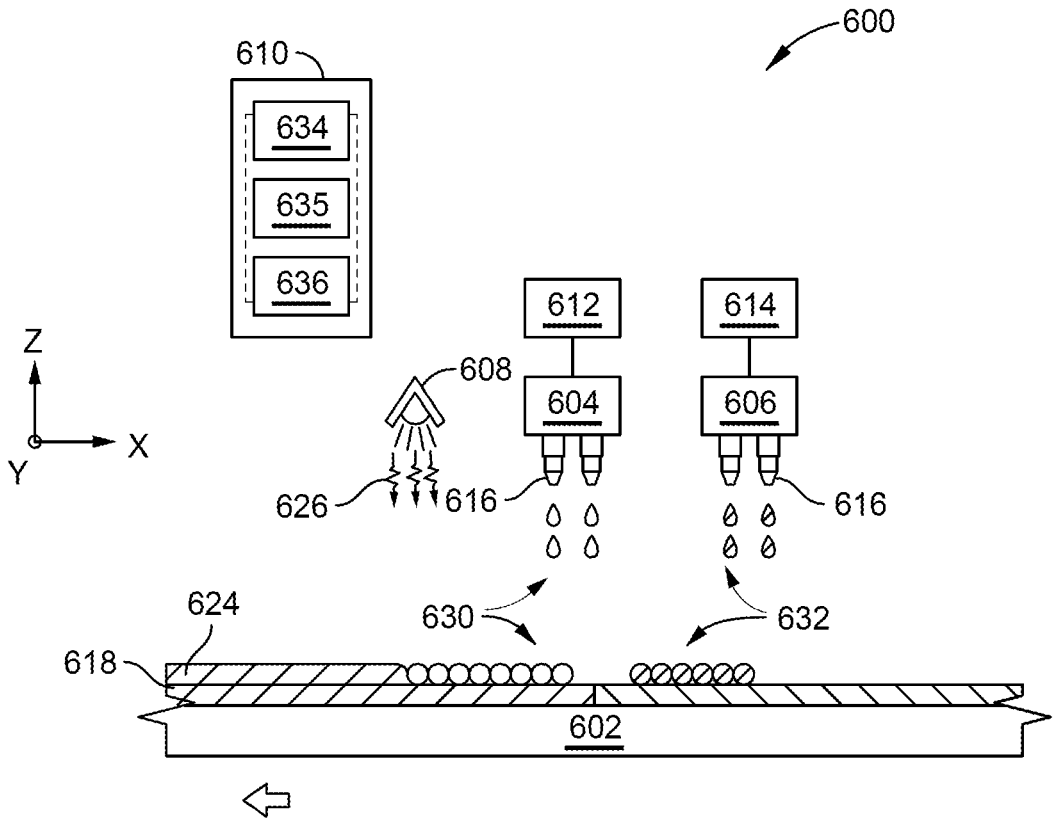
FIG. 6A is a schematic sectional view of an additive manufacturing system, which may be used to form the polishing pads described herein.

FIG. 6A is a schematic sectional view of an additive manufacturing system, which may be used to form the polishing pads described herein, according to some embodiments. Here, the additive manufacturing system 600 features a movable manufacturing support 602, a plurality of dispense heads 604 and 606 disposed above the manufacturing support 602, a curing source 608, and a system controller 610. In some embodiments, the dispense heads 604, 606 move independently of one another and independently of the manufacturing support 602 during the polishing pad manufacturing process. Here, the first and second dispense heads 604 and 606 are respectively fluidly coupled to a first pre-polymer composition source 612 and a sacrificial material source 614. Typically, the additive manufacturing system 600 features at least one more dispense head (e.g., a third dispense head, not shown) which is fluidly coupled to a second pre-polymer composition source used to form a foundation layer. In some embodiments, the additive manufacturing system 600 includes as many dispense heads as desired to each dispense a different pre-polymer composition or sacrificial material precursor composition. In some embodiments, the additive manufacturing system 600 further includes pluralities of dispense heads where two or more dispense heads are configured to dispense the same pre-polymer compositions or sacrificial material precursor compositions.

Here, each of dispense heads 604, 606 features an array of droplet ejecting nozzles 616 configured to eject droplets 630, 632 of the respective pre-polymer composition from the first pre-polymer composition source 612 and sacrificial material composition from the sacrificial material composition source 614 delivered to the dispense head reservoirs. Here, the droplets 630, 632 are ejected towards the manufacturing support 602 and thus onto the manufacturing support 602 or onto a previously formed print layer 618 disposed on the manufacturing support 602. Typically, each of dispense heads 604, 606 is configured to fire (control the ejection of) droplets 630, 632 from each of the nozzles 616 in a respective geometric array or pattern independently of the firing of other nozzles 616 thereof. Herein, the nozzles 616 are independently fired according to a droplet dispense pattern for a print layer to be formed, such as the print layer 624, as the dispense heads 604, 606 move relative to the manufacturing support 602. Once dispensed, the droplets 630 of the pre-polymer composition from the first pre-polymer composition source 612 and/or the droplets 632 of the sacrificial material composition from the sacrificial material composition source 614 are at least partially cured by exposure to electromagnetic radiation, e.g., UV radiation 626, provided by the curing source 608, e.g., an electromagnetic radiation source, such as a UV radiation source to form a print layer, such as the partially formed print layer 624.

Here, the additive manufacturing system 600 shown in FIG. 6A further includes the system controller 610 to direct the operation thereof. The system controller 610 includes a programmable central processing unit (CPU) 634 which is operable with a memory 635 (e.g., non-volatile memory) and support circuits 636. The support circuits 636 are conventionally coupled to the CPU 634 and include cache, clock circuits, input/output subsystems, power supplies, and the like, and combinations thereof coupled to the various components of the additive manufacturing system 600, to facilitate control thereof. The CPU 634 is one of any form of general purpose computer processor used in an industrial setting, such as a programmable logic controller (PLC), for controlling various components and sub-processors of the additive manufacturing system 600. The memory 635, coupled to the CPU 634, is non-transitory and is typically one or more of readily available memories such as random access memory (RAM), read only memory (ROM), floppy disk drive, hard disk, or any other form of digital storage, local or remote.

Typically, the memory 635 is in the form of a computer-readable storage medium containing instructions (e.g., non-volatile memory), which when executed by the CPU 634, facilitates the operation of the additive manufacturing system 600. The instructions in the memory 635 are in the form of a program product such as a program that implements the methods of the present disclosure.

The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure. In some embodiments, the methods set forth herein, or portions thereof, are performed by one or more application specific integrated circuits (ASICs), field-programmable gate arrays (FPGAs), or other types of hardware implementations. In some other embodiments, the polishing pad manufacturing methods set forth herein are performed by a combination of software routines, ASIC(s), FPGAs and, or, other types of hardware implementations.

Here, the system controller 610 directs the motion of the manufacturing support 602, the motion of the dispense heads 604 and 606, the firing of the nozzles 616 to eject droplets of pre-polymer compositions therefrom, and the degree and timing of the curing of the dispensed droplets provided by the curing source 608. In some embodiments, the instructions used by the system controller to direct the operation of the additive manufacturing system 600 include droplet dispense patterns for each of the print layers to be formed. In some embodiments, the droplet dispense patterns are collectively stored in the memory 635 as CAD-compatible digital printing instructions.

Figure 6B:
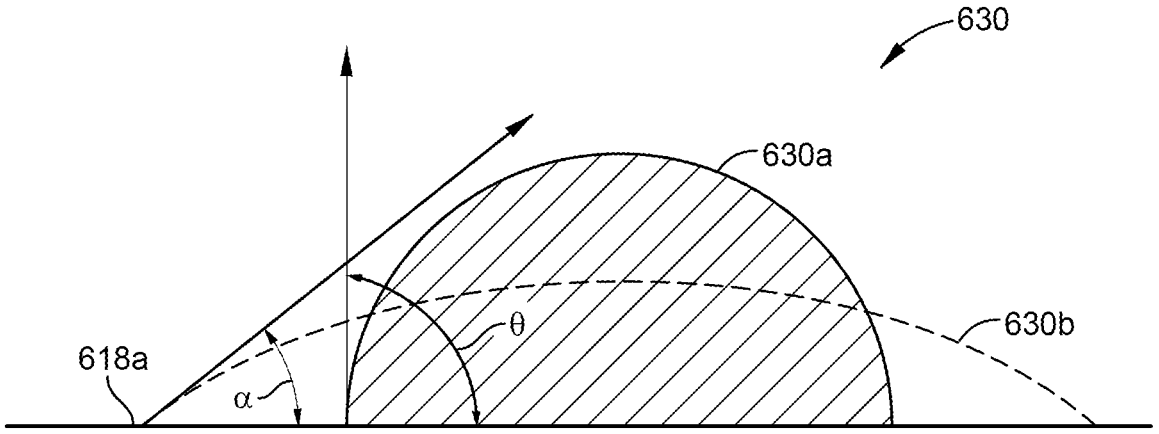
FIG. 6B is a close-up cross-sectional view schematically illustrating a droplet disposed on a surface of a previously formed print layer according to embodiments described herein.

In some embodiments, dispensed droplets of the pre-polymer compositions, such as the dispensed droplets 630 of the pre-polymer composition from the first pre-polymer composition source 612, are exposed to electromagnetic radiation to physically fix the droplet before it spreads to an equilibrium size such as set forth in the description of FIG. 6B. Typically, the dispensed droplets are exposed to electromagnetic radiation to at least partially cure the pre-polymer compositions thereof within 1 second or less of the droplet contacting a surface, such as the surface of the manufacturing support 602 or of a previously formed print layer 618 disposed on the manufacturing support 602.

FIG. 6B is a close up cross-sectional view schematically illustrating a droplet 630 disposed on a surface 618*a* of a previously formed layer, such as the previously formed layer 618 described in FIG. 6A, according to some embodiments. In a typical additive manufacturing process, a droplet of pre-polymer composition, such as the droplet 630, spreads and reaches an equilibrium contact angle $\alpha$ with the surface 618*a* of the previously formed layer within about one second from the moment in time that the droplet 630 contacts the surface 618*a*. The equilibrium contact angle $\alpha$ is a function of at least the material properties of the pre-polymer composition and the energy at the surface 618*a* (surface energy) of the previously formed layer. In some embodiments, it is desirable to at least partially cure the dispensed droplet before it reaches an equilibrium size in order to fix the droplet's contact angle with the surface 618*a* of the previously formed layer. In those embodiments, the fixed droplet's 630*a* contact angle $\theta$ is greater than the equilibrium contact angle $\alpha$ of the droplet 630*b* (shown in phantom) of the same pre-polymer composition, which was allowed to spread to its equilibrium size.

Herein, at least partially curing a dispensed droplet causes at least partial polymerization, e.g., cross-linking, of the pre-polymer composition(s) within the droplets and with adjacently disposed droplets of the same or different pre-polymer compositions to form a continuous polymer phase. In some embodiments, the pre-polymer compositions are dispensed and at least partially cured to form a well about a desired pore before a sacrificial material composition is dispensed thereinto.

Formulation and Material Examples

Pre-polymer compositions of the present disclosure may include a mixture of one or more of functional polymers, functional oligomers, functional monomers, functional cross-linkers, reactive diluents, additives, and photoinitiators.

Examples of suitable functional polymers which may be used to form one or both of the at least two pre-polymer compositions include multifunctional acrylates including di, tri, tetra, and higher functionality acrylates, such as 1,3,5-triacryloylhexahydro-1,3,5-triazine or trimethylolpropane triacrylate, dipropylene glycol diacrylate or dimethacrylate.

Examples of suitable functional oligomers which may be used to form one or both of the at least two pre-polymer compositions include monofunctional and multifunctional oligomers, acrylate oligomers, such as aliphatic urethane acrylate oligomers, aliphatic hexafunctional urethane acrylate oligomers, diacrylate, aliphatic hexafunctional acrylate oligomers, multifunctional urethane acrylate oligomers, aliphatic urethane diacrylate oligomers, aliphatic urethane acrylate oligomers, aliphatic polyester urethane diacrylate blends with aliphatic diacrylate oligomers, or combinations thereof, for example bisphenol-A ethoxylate diacrylate or polybutadiene diacrylate, tetrafunctional acrylated polyester oligomers, aliphatic polyester based urethane diacrylate oligomers and aliphatic polyester based acrylates and diacrylates.

Examples of suitable monomers which may be used to from one or both of the at least two pre-polymer compositions include both mono-functional monomers and multifunctional monomers. Suitable mono-functional monomers include tetrahydrofurfuryl acrylate (e.g. SR285 from Sartomer®), tetrahydrofurfuryl methacrylate, vinyl caprolactam, isobornyl acrylate, isobornyl methacrylate, 2-phenoxyethyl acrylate, 2-phenoxyethyl methacrylate, 2-(2-ethoxyethoxy)ethyl acrylate, isooctyl acrylate, isodecyl acrylate, isodecyl methacrylate, lauryl acrylate, lauryl methacrylate, stearyl acrylate, stearyl methacrylate, cyclic trimethylolpropane formal acrylate, 2-[[(Butylamino) carbonyl] oxy]ethyl acrylate (e.g. Genomer 1122 from RAHN USA Corporation), cycloaliphatic acrylate (e.g. SR217 from Sartomer®), 3,3,5-trimethylcyclohexyl acrylate, or mono-functional methoxylated PEG (350) acrylate. Suitable multifunctional monomers include diacrylates or dimethacrylates of diols and polyether diols, such as propoxylated neopentyl glycol diacrylate, 1,6-hexanediol diacrylate, 1,6-hexanediol dimethacrylate, 1,3-butylene glycol diacrylate, 1,3-butylene glycol dimethacrylate 1,4-butanediol diacrylate, 1,4-butanediol dimethacrylate, alkoxylated aliphatic diacrylate (e.g., SR9209A from Sartomer®), diethylene glycol diacrylate, diethylene glycol dimethacrylate, dipropylene glycol diacrylate, tripropylene glycol diacrylate, triethylene glycol dimethacrylate, alkoxylated hexanediol diacrylates, or combinations thereof, for example SR508, SR562, SR563, SR564 from Sartomer®.

Typically, the reactive diluents used to form one or more of the pre-polymer compositions are least monofunctional, and undergo polymerization when exposed to free radicals, Lewis acids, and/or electromagnetic radiation. Examples of suitable reactive diluents include monoacrylate, 2-ethylhexyl acrylate, octyldecyl acrylate, cyclic trimethylolpropane formal acrylate, caprolactone acrylate, isobornyl acrylate (IBOA), or alkoxylated lauryl methacrylate. In some examples, reactive diluents may include Genocure series products, such as PBZ, or Genomer series products, such as Genomer 5142, each manufactured by Rahn AG of Zurich, Switzerland.

Examples of suitable additives include surface modifiers such as surfactants to control surface tension. Some example additives may include ethoxylated polydimethylsiloxanes, such as BYK series products, such as BYK-307, manufactured by BYK-Chemie GmbH of Wesel, Germany.

Examples of suitable photoinitiators used to form one or more of the at least two different pre-polymer compositions include polymeric photoinitiators and/or oligomer photoinitiators, such as benzoin ethers, benzyl ketals, acetyl phenones, alkyl phenones, phosphine oxides, benzophenone compounds and thioxanthone compounds that include an amine synergist, or combinations thereof. In some examples, photoinitiators may include Irgacure® series products, such as Irgacure® 819, manufactured by BASF of Ludwigshafen, Germany.

Examples of polishing pad materials formed of the pre-polymer compositions described above typically include at least one of oligomeric and, or, polymeric segments, compounds, or materials selected from the group consisting of: polyamides, polycarbonates, polyesters, polyether ketones, polyethers, polyoxymethylenes, polyether sulfone, polyetherim ides, polyimides, polyolefins, polysiloxanes, polysulfones, polyphenylenes, polyphenylene sulfides, polyurethanes, polystyrene, polyacrylonitriles, polyacrylates, polymethylmethacrylates, polyurethane acrylates, polyester acrylates, polyether acrylates, epoxy acrylates, polycarbonates, polyesters, melamines, polysulfones, polyvinyl materials, acrylonitrile butadiene styrene (ABS), halogenated polymers, block copolymers, and random copolymers thereof, and combinations thereof.

The sacrificial material composition(s), which may be used to form the pore-features described above, include water-soluble materials, such as, glycols (e.g., polyethylene glycols), glycol-ethers, and amines. Examples of suitable sacrificial material precursors which may be used to form the pore forming features described herein include ethylene glycol, butanediol, dimer diol, propylene glycol-(1,2) and propylene glycol-(1,3), octane-1,8-diol, neopentyl glycol, cyclohexane dimethanol (1,4-bis-hydroxymethylcyclohexane), 2-methyl-1,3-propane diol, glycerine, trimethylolpropane, hexanediol-(1,6), hexanetriol-(1,2,6) butane triol-(1,2,4), trimethylolethane, pentaerythritol, quinitol, mannitol and sorbitol, methylglycoside, also diethylene glycol, triethylene glycol, tetraethylene glycol, polyethylene glycols, dibutylene glycol, polybutylene glycols, ethylene glycol, ethylene glycol monobutyl ether (EGMBE), diethylene glycol monoethyl ether, ethanolamine, diethanolamine (DEA), triethanolamine (TEA), and combinations thereof.

In some embodiments, the sacrificial material precursor includes a water soluble polymer, such as 1-vinyl-2-pyrrolidone, vinylimidazole, polyethylene glycol diacrylate, acrylic acid, sodium styrenesulfonate, Hitenol BC10®, Maxemul 6106®, hydroxyethyl acrylate and [2-(methacryloyloxy)ethyltrimethylammonium chloride, 3-allyloxy-2-hydroxy-1-propanesulfonic acid sodium, sodium 4-vinylbenzenesulfonate, [2-(methacryloyloxy)ethyl]dimethyl-(3-sulfopropyl)ammonium hydroxide, 2-acrylamido-2-methyl-1-propanesulfonic acid, vinylphosphonic acid, allyltriphenylphosphonium chloride, (vinylbenzyl)trimethylammonium chloride, E-SPERSE RS-1618, E-SPERSE RS-1596, methoxy polyethylene glycol monoacrylate, methoxy polyethylene glycol diacrylate, methoxy polyethylene glycol triacrylate, or combinations thereof.

Exemplary High Temperature Formulations and Material Properties Thereof

Pre-polymer compositions of the present disclosure have values of glass transition temperature ($T_g$) that are greater than $T_g$ values for conventional formulations. In some embodiments, $T_g$ values are raised by adding high $T_g$ monomers and/or by adding cross-linkers to increase cross-linking density, which increases $T_g$. In some embodiments, $T_g$ values for pre-polymer compositions disclosed herein are about 80° C. or more, such as about 80° C. to about 200° C., such as about 80° C. to about 160° C., such as about 80° C. to about 120° C., such as about 80° C. to about 100° C., such as about 80° C. to about 90° C., such as about 80° C. In some embodiments, the greater $T_g$ values of the pre-polymer compositions correlate to polishing pad materials that maintain consistent material properties and stable performance over a wider temperature range, including at higher temperatures, compared to conventional pad materials. The term "pad material" may refer to a polymer structure formed from a pre-polymer composition without sacrificial materials or pore-features. In some embodiments, values for storage modulus E' at a temperature of about 80° C. (E'80) for pad materials disclosed herein are maintained above a target value, such as about 200 MPa or greater, in contrast to conventional pad materials with E'80 values well below 150 MPa, such as about 100 MPa or less. In some examples, conventional pad materials may only maintain storage modulus values above 150 MPa at temperatures below about 70° C. In some embodiments, E'80 target values for pad materials disclosed herein are about 200 MPa or greater, such as about 210 MPa or greater, such as about 220 MPa or greater, such as about 230 MPa or greater, such as about 240 MPa or greater, such as about 250 MPa or greater, or about 200 MPa to about 210 MPa, about 210 MPa to about 220 MPa, about 220 MPa to about 230 MPa, about 230 MPa to about 240 MPa, about 240 MPa to about 250 MPa, or about 200 MPa, 210 MPa, 220 MPa, 230 MPa, 240 MPa, or about 250 MPa.

In some implementations, the higher $T_g$ values may be expected to increase polishing non-uniformity due to the harder pad materials being less compliant to the surface of the substrate. However, in combination with the use of segmented polishing elements that are disposed on a relatively more compliant foundation layer as described above, non-uniformity is reduced compared to conventional pad materials.

Suitable high $T_g$ monomers may include monofunctional acrylates, such as isobornyl acrylate (IBXA) or 3,3,5-Trimethylcyclohexyl acrylate (TMCHA), diethyl acrylamide isobornyl methacrylate, 3,3,5-trimethylcyclohexyl methacrylate, diethyl methacrylamide, or combinations thereof. In some embodiments, IBXA content may be within a range of about 20 wt % or greater, such as about 25 wt % or greater, such as about 30 wt % or greater, such as about 35 wt % or greater, or about 20 wt % to about 40 wt %, such as about 25 wt % to about 40 wt %, such as about 30 wt % to about 40 wt %, such as about 33 wt %. IBXA is a monofunctional acrylate. The term "functionality" may refer to the number of reactive or cross-linkable functional groups per molecule. IBXA may have a purity of about 95% or more, such as about 99% or more, such as about 99.5% or more. IBXA contains less alcohol content (e.g., isobornyl alcohol) compared to lower purity isobornyl acrylate (which may be referred to as "IBOA"). IBOA may have a purity of about 91% to about 92%. The alcohol component can act as a plasticizer leading to lower $T_g$ and storage modulus values for the pad materials. Therefore, the lower alcohol content of IBXA increases $T_g$ and storage modulus values compared to conventional pad materials. The term "plasticizer" may refer to a neutral material that does not participate in the cross-linking process.

In some embodiments, TMCHA content is within a range of about 20 wt % or greater, such as about 5 wt % or greater, such as about 10 wt % or greater, such as about 15 wt % or greater, or about 5 wt % to about 15 wt %, such as about 10 wt % to about 15 wt %, such as about 12 wt %. TMCHA is a monofunctional acrylate. In some other embodiments, suitable monomers have a functionality greater than one. The addition of high $T_g$ monomers helps maintain the viscosity of the pre-polymer compositions within a range that is suitable for printing, such as within a range of about 6 cP to about 20 cP at 70° C.

Suitable cross-linkers may include aliphatic urethanes, such as difunctional aliphatic urethane methacrylate (e.g., BR series products, such as BR952, manufactured by Dymax Corporation of Torrington, CT, USA), or aliphatic acrylates, such as neopentyl glycol diacrylate or dimethacrylate or dipropylene glycol diacrylate or dimethacrylate, or combinations thereof. In some embodiments, BR952 content is within a range of about 30 wt % or greater, such as about 35 wt % or greater, such as about 40 wt % or greater, such as about 45 wt % or greater, or about 30 wt % to about 50 wt %, such as about 35 wt % to about 50 wt %, such as about 40 wt % to about 50 wt %, such as about 43 wt %. The difunctional methacrylate of BR952 results in higher $T_g$ compared to some other cross-linkers with similar levels of cross-linking efficiency. In some examples, other difunctional cross-linkers similar to BR952, for example having short chain length (e.g., within a range of about 2 to about 16 mer units) and methacrylate end groups, may be used in place of BR952 at the same concentrations. In some examples, other types of cross-linkers may be added such as di-acrylates, di-methacrylates, and polyfunctional acrylates and methacrylates. In some embodiments, suitable cross-linkers have a functionality of two or greater, such as two to three, such as two or three. Some examples of cross-linkers that have a functionality of three are trimethylol triacrylate or trimethacrylate.

In some embodiments, functionality of three or greater increases the number of unused reactive groups with increased functionality, which undesirably lowers values of $T_g$ and storage modulus. Nevertheless, increased participation of acrylic groups based on the curing conditions can increase modulus. Unused reactive groups may act as a plasticizer leading to lower $T_g$ and storage modulus values for the pad materials. The term "cross-linking efficiency" may refer to the fraction of cross-linkable functional groups that are consumed in the cross-linked pad materials. Therefore, based on the plasticizing effect of unused reactive groups, cross-linking efficiency is important independent of total cross-linking density. In general, cross-linking efficiency is molecule dependent. For example, the cross-linking efficiency of methacrylates is often lower than acrylates. Therefore, the degree of functionality may not be directly comparable between different molecules. For example, other cross-linkers having a functionality of four or greater, such as tetrafunctional polyether acrylates, such as Ebecryl 40, manufactured by Allnex GmbH of Frankfurt, Germany, which has a functionality of four, or acrylo Polyhedral Oligomeric Silsesquioxane (POSS) (available from Hybrid Plastics Inc. of Hattiesburg, MS, USA), which has a functionality of eight, provide relatively high cross-linking efficiency compared to some other cross-linkers with a functionality below four. Acrylo POSS has a cage structure. Some examples of acrylo POSS are MA series products, such as MA0735, MA0736 and MA0701, manufactured by Hybrid Plastics Inc. of Hattiesburg, MS, USA. In some embodiments, suitable cross-linkers have a cross-linking efficiency of about 40% to about 90%. In some embodiments, the pad materials have a cross-linking density of about 50% to about 80%.

An undesirable side effect of using high $T_g$ monomers and increased cross-linking is that warping of the polishing pad may occur during printing. The term "warping" may refer to deformation or curling of the polishing pad. Warping may be caused by stress induced within the printed materials due to cure shrinkage of the materials. Cure shrinkage is more pronounced for smaller molecular weights. Therefore, addition of oligomers having relatively larger molecular weights helps reduce the stress and reduce warping. Suitable oligomers may include aliphatic urethanes, such as difunctional aliphatic urethane acrylates (e.g., Ebecryl series products, such as Ebecryl 270, manufactured by Allnex GmbH of Frankfurt, Germany, CN series products, such as CN964 and CN991, manufactured by Sartomer USA, LLC of Exton, PA, USA, or combinations thereof). In some embodiments, Ebecryl 270 content is within a range of about 20 wt % or less, such as about 5 wt % to about 10 wt %, such as about 7 wt %. Alternatively, other difunctional oligomers similar to Ebecryl 270, for example having a chain length within a range of about 30 to about 200 mer units) and acrylate end groups, may be used in place of Ebecryl 270 at the same concentrations.

An exemplary high temperature formulation, according to the parameters set forth above, is summarized in Table 2.

TABLE 1

| Component | Type | End Groups | Functionality | Weight % |
|---|---|---|---|---|
| Ebecryl 270 | Oligomer | Acrylate | 2 | 6.7 |
| BR952 | Cross-linker | Methacrylate | 2 | 42.8 |
| IBXA | Monomer | Acrylate | 1 | 33.3 |
| TMCHA | Monomer | Acrylate | 1 | 12.4 |
| BYK307 | Additive | | | 0.1 |
| Irgacure 819 | Photoinitiator | | | 1.9 |
| PBZ | Reactive Diluent | | | 0.7 |
| Genomer 5142 | Reactive Diluent | | | 2.1 |

Additive Manufacturing Process Examples

Figure 7:
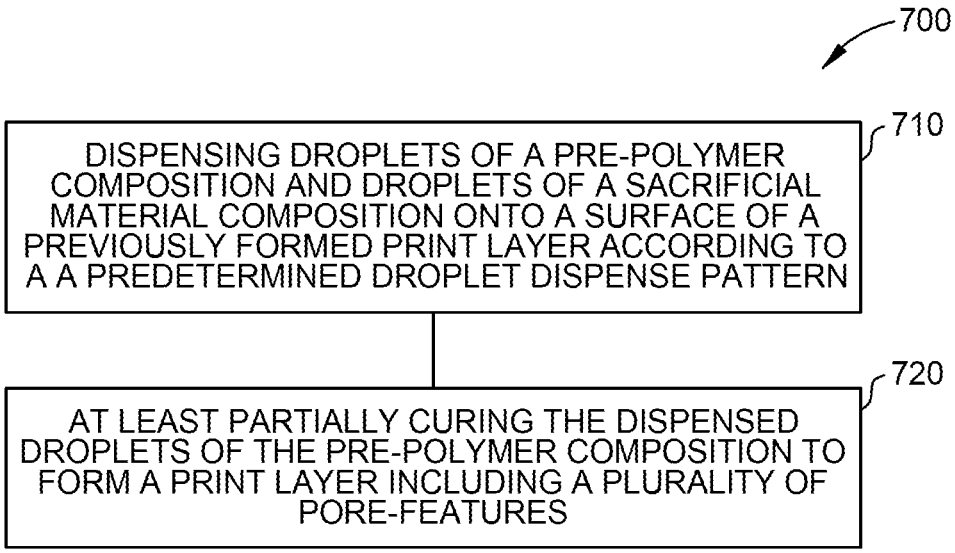
FIG. 7 is a diagram setting forth a method of forming a polishing pad according to embodiments described herein.

FIG. 7 is a diagram setting forth a method of forming a print layer of a polishing pad according to embodiments described herein. Embodiments of the method 700 may be used in combination with one or more of the systems and system operations described herein, such as the additive manufacturing system 600 of FIG. 6A and the fixed droplets of FIG. 6B. Further, embodiments of the method 700 may be used to form any one or combination of embodiments of the polishing pads shown and described herein.

At activity 710, the method 700 includes dispensing droplets of a pre-polymer composition and droplets of a sacrificial material composition onto a surface of a previously formed print layer according to a predetermined droplet dispense pattern.

At activity 720, the method 700 includes at least partially curing the dispensed droplets of the pre-polymer composition to form a print layer including a plurality of pore-features.

In some embodiments, the method 700 further includes sequential repetitions of activities 710 and 720 to form a plurality of print layers stacked in a Z-direction, i.e., a direction orthogonal to the surface of the manufacturing support or a previously formed print layer disposed thereon. The predetermined droplet dispense pattern used to form each print layer may be the same or different as a predetermined droplet dispense pattern used to form a previous print layer disposed there below. In some embodiments, the plurality of print layers include a polishing layer having a plurality of pore-features formed therein. In some embodiments, the plurality of print layers include a polishing layer having a plurality of pore-forming features formed therein in which the plurality of pore-forming features include the sacrificial material composition.

Polishing Pad Material Performance

Figure 8A:
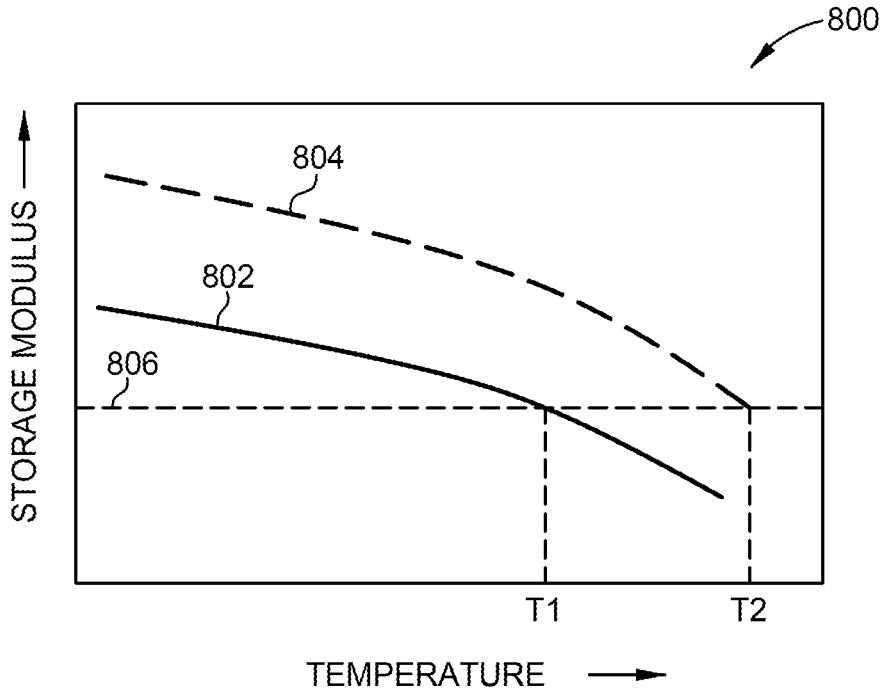
FIG. 8A is a graph illustrating storage moduli for polishing pads as a function of temperature according to embodiments described herein.

FIG. 8A is a graph 800 illustrating storage moduli for polishing pads as a function of temperature. Curve 802 corresponds to conventional polishing pad materials. Curve 804 corresponds to polishing pad materials of the present disclosure. Dotted line 806 corresponds to a lower threshold for storage modulus. Polishing pads with storage modulus values below dotted line 806 result in poor performance (e.g., high wear rate, high dishing, and/or high erosion). In some embodiments, the dotted line 806 corresponds to a storage modulus value of about 200 MPa or greater, such as about 210 MPa or greater, such as about 220 MPa or greater, such as about 230 MPa or greater, such as about 240 MPa or greater, such as about 250 MPa or greater, or about 200 MPa to about 210 MPa, about 210 MPa to about 220 MPa, about 220 MPa to about 230 MPa, about 230 MPa to about 240 MPa, about 240 MPa to about 250 MPa, or about 200 MPa, 210 MPa, 220 MPa, 230 MPa, 240 MPa, or about 250 MPa. As shown in FIG. 8A, curve 804 is shifted to upwards compared to curve 802 indicating that the polishing pad materials disclosed herein have elevated storage modulus values over a wide temperature range compared to conventional polishing pad materials. Curve 802 intersects dotted line 806 at temperature T1. Curve 804 intersects dotted line 806 at temperature T2 greater than T1. Therefore, as shown in FIG. 8A, the polishing pad materials of the present disclosure have a higher temperature operating window compared to conventional polishing pad materials. In some embodiments, the difference between T1 and T2 is about 10° C. or more, such as about 20° C. or more, such as about 20° C. to about 40° C., such as about 20° C. to about 30° C., or about 30° C. to about 40° C. In some embodiments, T2 is about 70° C. or more, such as about 80° C. or more, such as about 90° C. or more, or about 70° C. to about 100° C., such as about 80° C. to about 100° C., such as about 90° C.

Figure 8B:
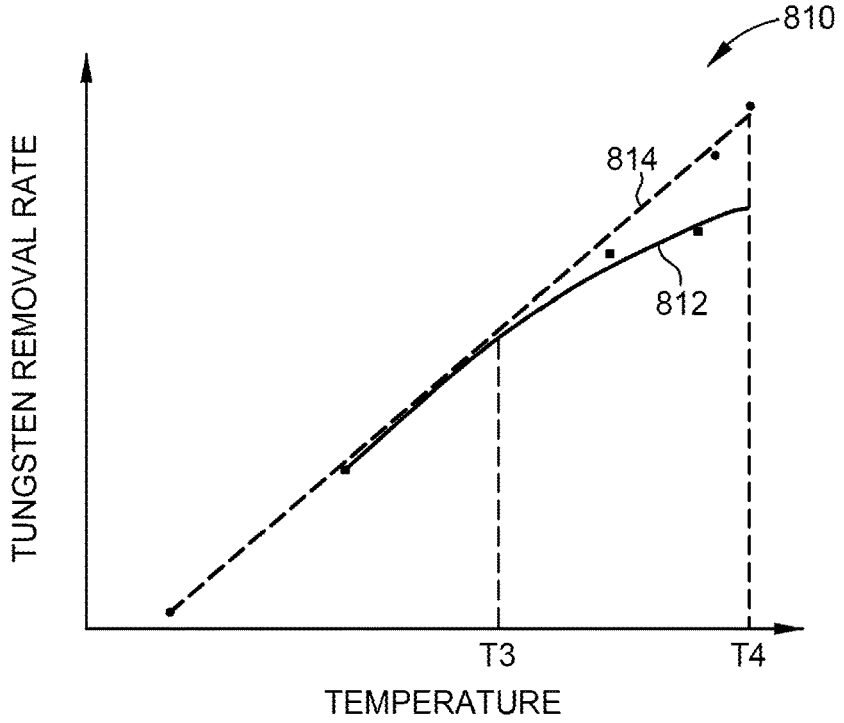
FIG. 8B is a graph illustrating tungsten removal rate for polishing pads as a function of temperature according to embodiments described herein.

FIG. 8B is a graph 810 illustrating tungsten removal rate for polishing pads as a function of temperature. Curve 812 corresponds to conventional polishing pad materials. Curve 814 corresponds to polishing pad materials of the present disclosure. As shown in FIG. 8B, curve 812 starts to level off at temperature T3, whereas curve 814 continues increasing beyond temperature T3. Curve 814 continues increasing at or near linear to at least temperature T4. As illustrated by the difference between curve 812 and curve 814, the polishing pad materials disclosed herein provide higher removal rates and maintain consistent polishing performance at higher temperatures compared to conventional polishing pad materials. In some embodiments, the difference between T3 and T4 is about 10° C. or more, such as about 20° C. or more, such as about 20° C. to about 40° C., such as about 20° C. to about 30° C., or about 30° C. to about 40° C. In some embodiments, T3 is about 60° C. or less. In some embodiments, T4 is about 70° C. or more, such as about 80° C. or more, such as about 90° C. or more, or about 70° C. to about 100° C., such as about 80° C. to about 100° C., such as about 90° C.

Figure 8C:
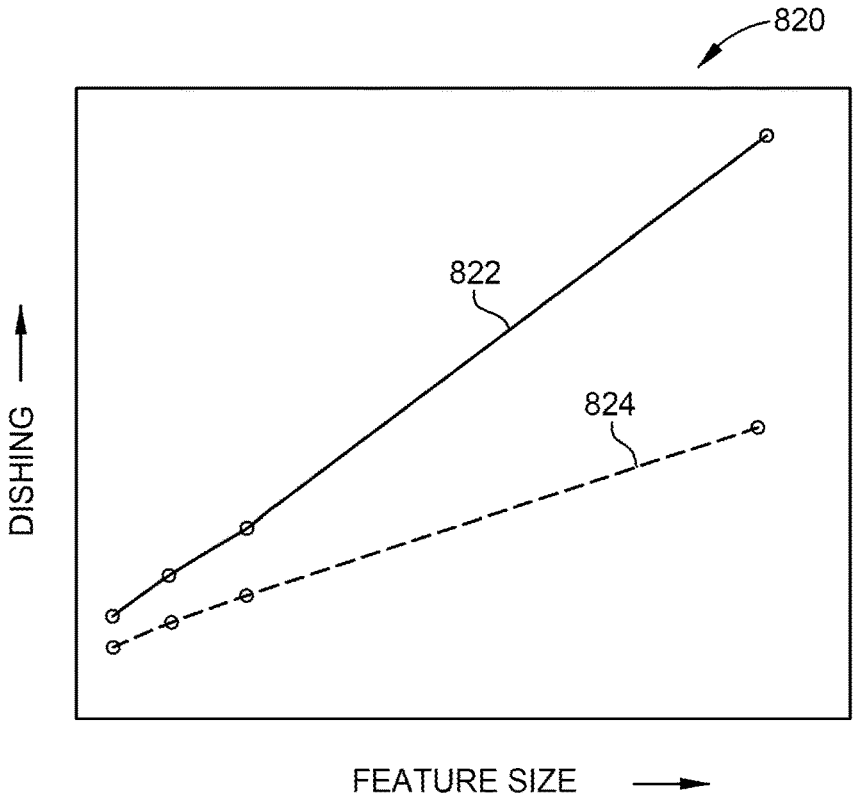
FIG. 8C is a graph illustrating dishing during polishing of substrates as a function of feature size according to embodiments described herein.

FIG. 8C is a graph 820 illustrating dishing during polishing of substrates as a function of feature size. Curve 822 corresponds to conventional polishing pad materials. Curve 824 corresponds to polishing pad materials of the present disclosure. As shown in FIG. 8C, dishing increases with feature size. Curve 824 is shifted downwards compared to curve 822 indicating that the polishing pad materials disclosed herein reduce dishing over a wide range of feature sizes compared to conventional polishing pad materials. In some examples, the feature sizes may be within a range of about 0.1 μm to about 10 μm. In some examples, the feature/array density may be about 50%. In some examples, dishing may be about 50 nm or less. In addition, the slope of curve 824 is lower than the slope of curve 822 indicating the polishing pad materials disclosed herein have more stable or consistent dishing performance and demonstrate greater dishing improvement at higher feature sizes compared to conventional polishing pad materials. In some embodiments, dishing for the polishing pad materials disclosed herein is reduced by about 20% or more, such as about 30% or more, such as about 40% or more, such as about 50% or more, compared to conventional polishing pad materials.

Figure 8D:
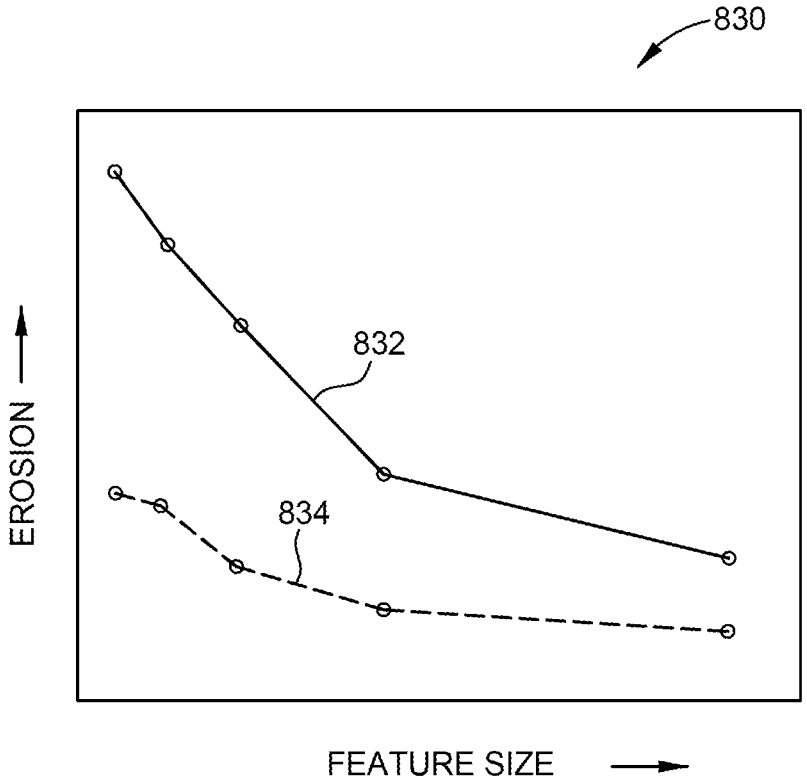
FIG. 8D is a graph illustrating erosion during polishing of substrates as a function of feature size according to embodiments described herein.

FIG. 8D is a graph 830 illustrating erosion during polishing of substrates as a function of feature size. Curve 832 corresponds to conventional polishing pad materials. Curve 834 corresponds to polishing pad materials of the present disclosure. As shown in FIG. 8D, erosion decreases with feature size. Curve 834 is shifted downwards compared to curve 832 indicating that the polishing pad materials disclosed herein reduce erosion over a wide range of feature sizes compared to conventional polishing pad materials. In some examples, the feature sizes may be within a range of about 0.1 μm to about 10 μm. In some examples, the feature/array density may be about 50%. In some examples, erosion may be about 500 nm or less. In addition, the slope of curve 834 is lower than the slope of curve 832 indicating the polishing pad materials disclosed herein have more stable or consistent erosion performance and demonstrate greater erosion improvement at lower feature sizes compared to conventional polishing pad materials. In some embodiments, erosion for the polishing pad materials disclosed herein is reduced by about 40% or more, such as about 50% or more, such as about 60% or more compared to conventional polishing pad materials.

While the foregoing is directed to embodiments of the present disclosure, other and further embodiments of the disclosure may be devised without departing from the basic scope thereof, and the scope thereof is determined by the claims that follow.

The invention claimed is:

1. A polishing pad, comprising:

a plurality of polishing elements, each comprising:

an individual surface that forms a portion of a polishing surface of the polishing pad; and one or more sidewalls extending downwardly from the individual surface to define a plurality of channels disposed between the polishing elements, wherein:

each of the polishing elements has a plurality of pore-features formed therein, each of the polishing elements is formed of a pre-polymer composition, the pre-polymer composition, comprising:

from about 40 wt % to about 50 wt % of a difunctional aliphatic urethane methacrylate, the difunctional aliphatic urethane methacrylate having a chain length within a range of about 2 to about 16 mer units and methacrylate end groups; and from about 5 wt % to about 10 wt % of a difunctional aliphatic urethane acrylate oligomer having a chain length within a range of about 30 to about 200 mer units and acrylate end groups;

the pre-polymer composition has a glass transition temperature ($T_g$) of about 80° C. or greater, and a storage modulus (E') of the pre-polymer composition at a temperature of 80° C. (E'80) is about 200 MPa or greater.

2. The polishing pad of claim 1, wherein the $T_g$ of the pre-polymer composition is about 80° C. to about 200° C.

3. The polishing pad of claim 1, wherein the pre-polymer composition comprises one or more monofunctional acrylate monomers.

4. The polishing pad of claim 3, wherein the pre-polymer composition comprises an isobornyl acrylate (IBXA) concentration of about 30 wt % to about 40 wt %.

5. The polishing pad of claim 3, wherein the pre-polymer composition comprises a 3,3,5-Trimethylcyclohexyl acrylate (TMCHA) concentration of about 10 wt % to about 15 wt %.

6. The polishing pad of claim 1, wherein the pre-polymer composition comprises one or more aliphatic acrylate cross-linkers selected from the group consisting of neopentyl glycol diacrylate, neopentyl glycol dimethacrylate, dipropylene glycol diacrylate, and dipropylene glycol dimethacrylate.

7. The polishing pad of claim 1, wherein the plurality of pore-features comprises a sacrificial material composition.

8. The polishing pad of claim 1, wherein the plurality of polishing elements are arranged to form corresponding segments of a spiral pattern, the spiral pattern extending from an inner radius of the polishing pad to an outer radius proximate to a circumference of the polishing pad.

9. The polishing pad of claim 1, wherein the plurality of polishing elements have a substantially rectangular shape and are arranged so that the plurality of channels defined therebetween form an X-Y grid pattern.

10. The polishing pad of claim 1, wherein the plurality of polishing elements are formed on a foundation layer and the foundation layer is formed from a pre-polymer composition that is different from the pre-polymer composition that forms the polishing elements.

11. The polishing pad of claim 10, wherein a portion of the polishing elements extend through an upward facing surface of the foundation layer to a location inside the foundation layer.

12. A polishing pad, comprising:

a plurality of polishing elements formed of a pre-polymer composition, the pre-polymer composition comprising:

an isobornyl acrylate (IBXA) concentration of about 30 wt % to about 40 wt %;

a 3,3,5-Trimethylcyclohexyl acrylate (TMCHA) concentration of about 10 wt % to about 15 wt %;

a difunctional aliphatic urethane methacrylate concentration of about 40 wt % to about 50 wt %, wherein the difunctional aliphatic urethane methacrylate has a chain length within a range of about 2 to about 16 mer units and methacrylate end groups; and a difunctional aliphatic urethane acrylate oligomer concentration of about 5 wt % to about 10 wt %, wherein the difunctional aliphatic urethane acrylate oligomer has a chain length within a range of about 30 to about 200 mer units and acrylate end groups, wherein the pre-polymer composition has a glass transition temperature ($T_g$) of about 80° C. or more, and wherein a storage modulus (E') of the pre-polymer composition at a temperature of 80° C. (E'80) is about 200 MPa or greater.

13. The polishing pad of claim 12, wherein the $T_g$ of the pre-polymer composition is about 80° C. to about 200° C.

14. The polishing pad of claim 12, wherein the plurality of polishing elements are arranged to form corresponding segments of a spiral pattern, the spiral pattern extending from an inner radius of the polishing pad to an outer radius proximate to a circumference of the polishing pad.

15. The polishing pad of claim 12, wherein the plurality of polishing elements have a substantially rectangular shape and are arranged so that a plurality of channels disposed between the polishing elements form an X-Y grid pattern.

16. The polishing pad of claim 12, wherein the plurality of polishing elements are formed on a foundation layer and the foundation layer is formed from a pre-polymer composition that is different from the pre-polymer composition that forms the polishing elements.

17. The polishing pad of claim 16, wherein a portion of the polishing elements extend through an upward facing surface of the foundation layer to a location inside the foundation layer.

18. A method of polishing a substrate, comprising:

disposing a substrate in a polishing system;

urging a material surface of the substrate against a polishing pad, the polishing pad having a plurality of polishing elements formed of a pre-polymer composition the pre-polymer composition, comprising:

from about 40 wt % to about 50 wt % of a difunctional aliphatic urethane methacrylate, the difunctional aliphatic urethane methacrylate having a chain length within a range of about 2 to about 16 mer units and methacrylate end groups; and from about 5 wt % to about 10 wt % of a difunctional aliphatic urethane acrylate oligomer having a chain length within a range of about 30 to about 200 mer units and acrylate end groups; and operating the polishing system at a temperature of about 80° C. or greater, wherein a storage modulus (E') of the pre-polymer composition at the operating temperature is about 200 MPa or greater and a glass transition temperature ($T_g$) of the pre-polymer composition is about 80° C. or more.

19. The method of claim 18, wherein the $T_g$ of the pre-polymer composition is about 80° C. to about 200° C.

20. The method of claim 18, wherein the pre-polymer composition comprises:

an isobornyl acrylate (IBXA) concentration of about 30 wt % to about 40 wt %; and a 3,3,5-Trimethylcyclohexyl acrylate (TMCHA) concentration of about 10 wt % to about 15 wt %.

* * * * *